US005303898A

United States Patent [19]

Engel et al.

[11] Patent Number: 5,303,898

[45] Date of Patent: Apr. 19, 1994

[54] OPEN END CONSTRUCTION FOR JACK

[75] Inventors: Darryl L. Engel, LaOtto; John R. Scoville, Butler, both of Ind.

[73] Assignee: Universal Tool & Stamping Company, Inc., Butler, Ind.

[21] Appl. No.: 32,095

[22] Filed: Mar. 17, 1993

[51] Int. Cl.[5] ..... B66F 3/08

[52] U.S. Cl. ..... 254/126

[58] Field of Search ..... 254/122, 126; 29/505, 29/509, 513, 517, 243.5

[56] References Cited

U.S. PATENT DOCUMENTS 1,761,358 6/1930 Mitchel ..... 25/509
3,236,938 2/1966 Toedtman ..... 29/517
4,802,653 2/1989 Engel ..... 254/126
5,064,171 11/1991 Engel .

*Primary Examiner*—Robert C. Watson
*Attorney, Agent, or Firm*—Hill, Steadman & Simpson

[57] ABSTRACT

An improved open end construction for jacks which provides for tabs which extend at right angles to the side surfaces of the channel members so as to allow pivot pins to be received in the open ends after which the tabs are bent so that they lie in the plane of the side surfaces of the channel members so as to lock the pivot pin in the ends of the channel assembly. Also, partial flanges can be formed about the openings in the ends of the channel members so as to provide bearing surfaces for the pivot pins.

3 Claims, 2 Drawing Sheets

OPEN END CONSTRUCTION FOR JACK

BACKGROUND OF THE INVENTION

1. Field of the Invention

This invention relates to scissors jacks with open end construction.

2. Description of Related Art

One means of assembling a jack is by using open end construction. Such open end construction is shown in U.S. Pat. No. 4,802,653, assigned to the assignee of the present invention. While this method is normally used at the trunion ends of the jack, open end construction could be used at any pivot point on the jack. In the structure illustrated in U.S. Pat. No. 4,802,653, the open ends of the legs are bent around the pivot point so as to retain the pivot shaft in the opening. In the typical trunion-channel assembly using open end design as shown in U.S. Pat. No. 4,802,653, once the trunion is inserted into the open end, the end tabs are simply bent toward each other, thus locking the trunion axle in place. Under normal conditions, this is very satisfactory since the linkage members of a jack are in compression when lifting a vehicle. The weakness of this design is that if a linkage member is loaded in tension, the tabs can be spread open again and let the assembly come apart. There are two reasons for this. First, the cross-sectional area of the tabs must be small enough to allow the tabs to bend and therefore are limited to how strong they could be made. Second, when the channel is placed in tension, the tensile force is applied to the tabs in the same plane that the tabs are bent. So as to prevent the tabs from spreading in the prior art jack, it is necessary to use higher strength steel than the jack would normally acquire.

SUMMARY OF THE INVENTION

The present invention provides an open end jack arrangement wherein tabs are bent at 90° to the plane to which the tensile force is applied in. Any tensile force is applied through a cross-section that is larger and is therefore stronger as compared to the prior art open end design.

It is an object of the present invention to provide an improved open end channel assembly for a jack which is formed with tabs which extend normal to the sides of the channel member during assembly and after the trunion has been placed in position, the tabs are bent toward each other so as to firmly lock the trunion in position.

It is another object of the invention to provide a partial flange about the pivot shaft so as to provide a bearing surface so as to strengthen the jack because of the increased bearing surface.

It is yet another object of the invention to provide an improved open end construction for a jack which allows the tabs of the upper and lower adjacent channel members which are provided with tabs that extend in opposite directions to be assembled by applying force to close the tabs.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figure 1:
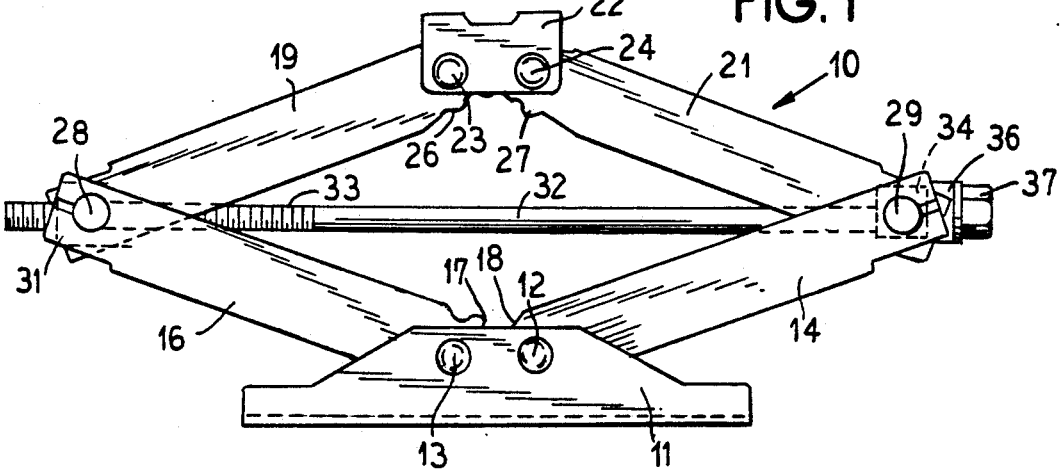
FIG. 1 is a side plan view of a scissors jack according to the invention.

FIGS. 1–4 show the first embodiment of the invention as applied to a scissors-type jack. As shown in FIG. 1, a base 11 pivotally supports lower channel members 14 and 16 with pivot pins 12 and 13. The channels 14 and 16 are formed with gear teeth 17 and 18 which mesh in a conventional manner.

The opposite ends of the channels 14, 16 are pivotally connected by pins 28 and 29 to upper channel members 19 and 21. Pin 28 is part of a threaded trunnion 31. The trunion 31 is mounted between the channels 16 and 19 and is formed with a threaded opening in which the threaded portion 33 of a shaft 32 can be received. Pin 29 is part of an open trunnion 34. The trunnion 34 is formed with an opening through which the shaft 32 extends. The shaft 32 carries a bearing 36 and a drive member 37 for rotating the shaft 32 so as to raise and lower the jack is attached to the end of shaft 32. Upper channel members 19 and 21 are connected by gears 26 and 27 and their upper ends are pivotally connected to a support member 22 by pins 23 and 24. The support member 22 engages a portion of a vehicle so as to raise it.

Figure 2:
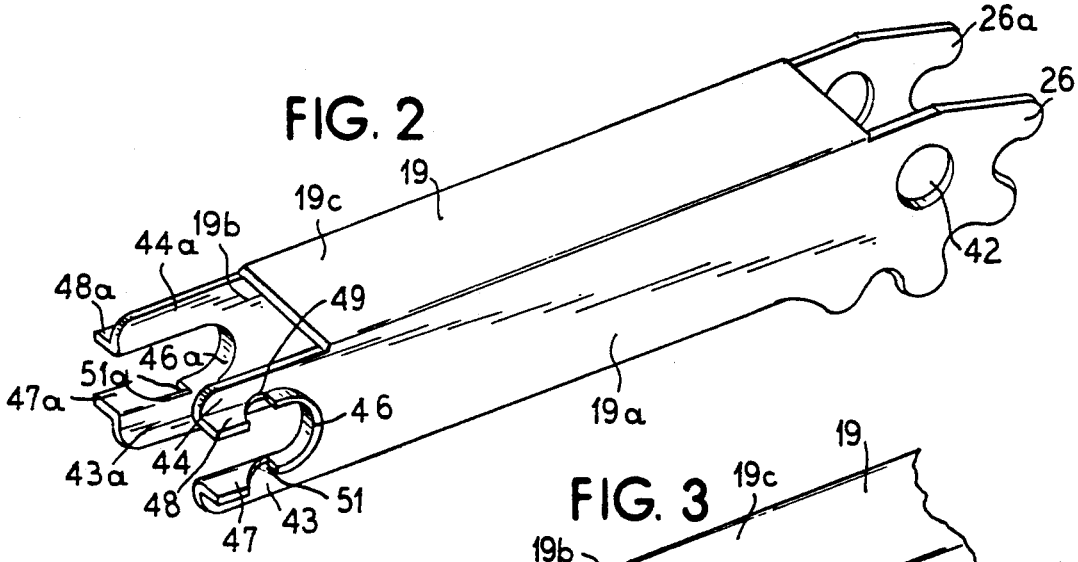
FIG. 2 is a perspective view illustrating a channel assembly with the improved invention.
Figure 3:
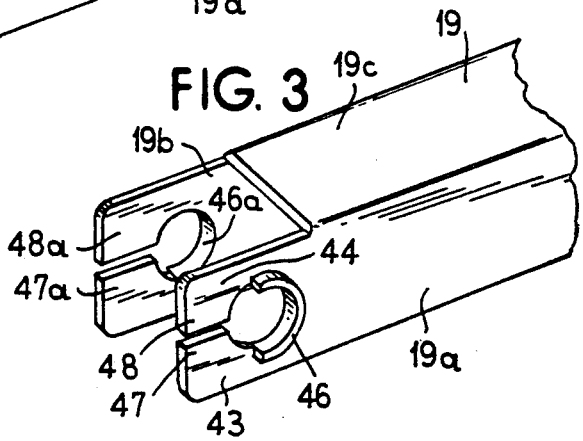
FIG. 3 is a partial cut-away view illustrating the tabs after they are bent to the locking position.
Figure 4:
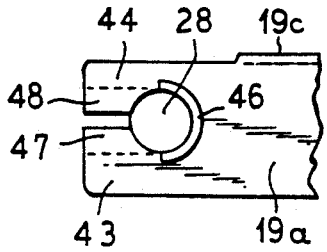
FIG. 4 is a plan view illustrating the tabs in the locked position.

The present invention relates to the manner in which the ends of the channel members 14, 16, 19 and 21 are attached to the pivot pins 28 and 29. FIGS. 2, 3 and 4 are detail views illustrating the first embodiment. The channel 19 has a top portion 19 and downwardly extending side portions **19*a* and 19*b*. The gears 26 and 26*a* mesh with the gears 27 of the upper channel assembly member 21. The end of the channel member 19 is formed so as to receive the pivot pin 28. An opening is formed between the extending portions 43 and 44 and tabs 47 and 48 are formed and are bent transversely of the plane of the side 19*a* of the channel member. It is to be realized that the tabs may be bent outwardly or inwardly. Openings 49 and 51 of generally arcuate shape are formed and join with a partial flange 46 which is formed so as to be bent outwardly at 90° to the side portion 19*a* as shown in FIG. 2. An opening is also formed in side portion 19*b* so as to form a partial flange 46*a* adjacent an opening 51*a*. Outwardly extending tabs 47*a* and 48*a* which extend from ends 43*a* and 44*a* are also formed. The lower channel 16 is also formed with similar ends. Channels 14 and 21** are also formed with slotted ends, partial flanges and tabs.

As shown in FIGS. 3 and 4, as the jack is being assembled, the pivot pins 28 and 29 are extended through the openings in the channel members 16, 19, 14 and 21 so that they rest against the partial flanges 46 and **46*a* and then the tabs 47, 48, 47*a* and 48*a*** are bent to the positions shown in FIG. 3 so as to hold the pivot pin 28 firmly within the end of the channel member 19. FIG. 4 is an end view illustrating the pivot pin 28 mounted in the end of the channel member 19 in the locked position. The other three channel members are mounted to the pivot pins 28 and 29 in a similar manner.

With the invention, the tabs 47 and 48 are bent at 90° to the plane to which the tensile force is applied. The tensile force is applied through a cross-sectional area that is larger and therefore the jack is stronger than could be obtained with the current end design.

Figure 5:
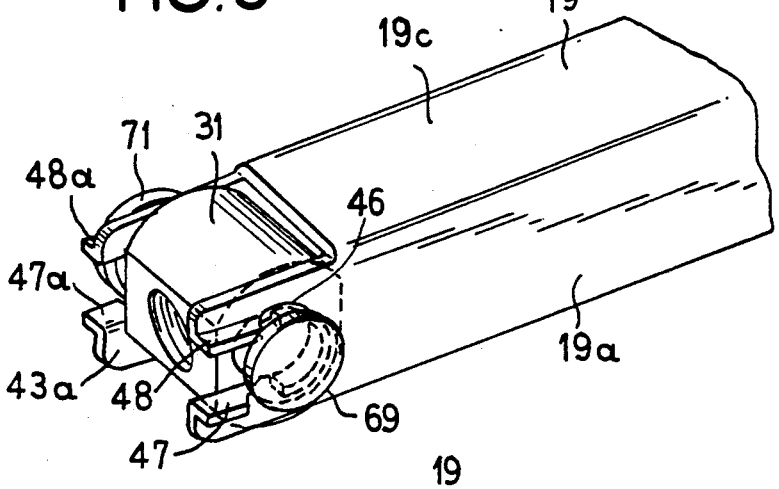
FIG. 5 illustrates a modified form of the invention.

The partial flange 46 increases the load bearing capacity of the channel by providing increased contact area for the trunion pin or axle. The partial flange could be used on any pivot point in the jack. In FIG. 3, the partial flange is shown as being separated from the closure tabs, but the partial flange and the tabs could be connected. The partial flange can also function as a spacer providing a space for the opened closure tab. FIG. 5 illustrates how the partial flange could be used with a trunion 31 that has a shoulder 69 at the end of the pivot 46. The other end of pin 46 has a shoulder 71 as shown in FIG. 5.

It is to be realized, of course, that the open end side extending tabs and the partial flange could be used independent of each other, although they are shown in combination in FIGS. 2-6.

Figure 6:
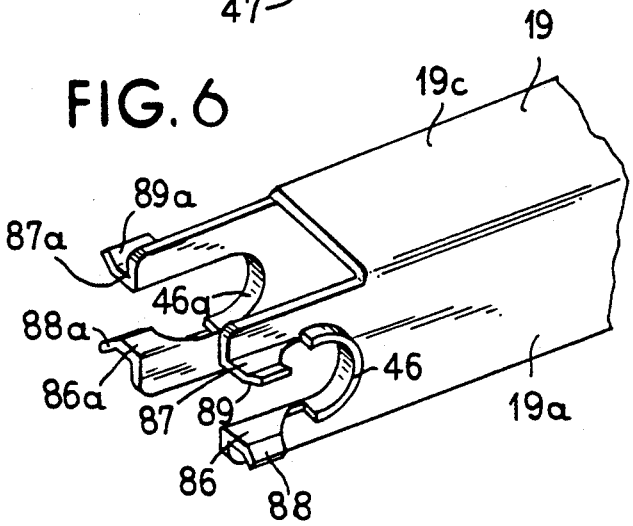
FIG. 6 illustrates a further modification of the invention.

FIG. 6 illustrates a modification of the closure tab shown in FIGS. 1-5 wherein the tabs are modified as shown to have two bended portions 86 and 88 and 87 and 89 such that the first portions of the tabs 87 and 86 can be bent so as to be aligned with the plane of the surface 19*a* after the shaft has been placed in position and the portions 88 and 89 extend substantially at right angles out from the surface 19*a* so as to provide spacers for the flanges 69 and 71 shown in FIG. 5. The tabs 86*a*, 87*a*, 88*a* and 89*a* are similarly arranged.

Figure 7:
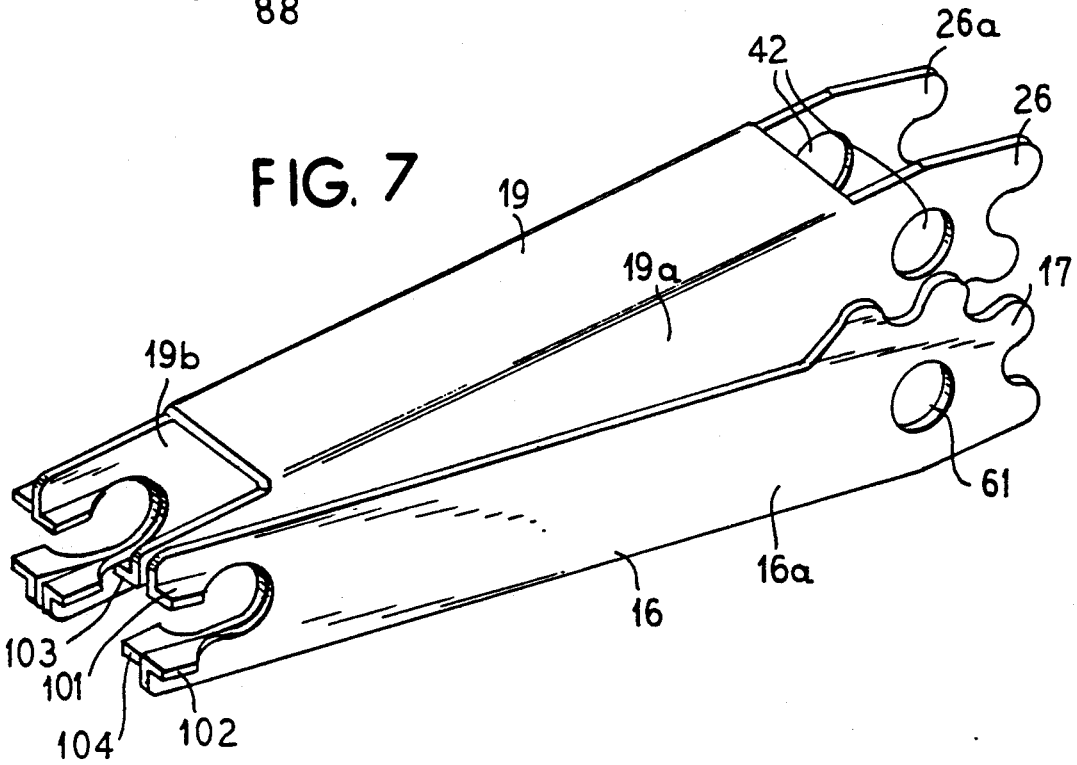
FIG. 7 illustrates yet another modification of the invention.

FIG. 7 illustrates how two linkage channel members 16 and 19 can be assembled. When in the opened position, the tabs 101 and 102 of one channel 16 extend outwardly and the tabs 103 and 104 of channel 19 extend inwardly. Thus, the tabs of the two channel extend in the opposite direction and after the pivot pin 29 is placed in position, the tabs 101, 102, 103 and 104 are bent to the closed position by moving a block parallel to the sides of the channels with a bent tip which will increase the force applied onto the tabs. Normally, the channel 19 is received in the lower channel 16 as shown. Thus, the tabs and/or the flanges can be bent outwardly or inwardly on the channel members.

It is seen that the present invention provides an improved end construction for jacks and although it has been described with respect to preferred embodiments, it is not to be so limited as changes and modifications can be made therein which are within the full intended scope as defined by the appended claims.

We claim as our invention:

1. A scissors jack made by the following process comprising, a base member, first and second lower channel members with side planar surfaces and with their lower ends pivotally attached to said base member and said first and second channel members formed with meshing gears, a support member, first and second upper channel members with side planar surfaces and with their upper ends pivotally attached to said support member, a threaded trunnion formed with a first pivot pin, a plain trunnion formed with a second pivot pin, the upper end of said first lower channel member and the lower end of said first upper channel member pivotally mounted on said first pivot pin of said threaded trunnion and the upper end of said second lower channel member and the lower end of said second upper channel member pivotally mounted on said second pivot pin of said plain trunnion, a shaft which extends through said plain trunnion and has a threaded portion received in said threaded trunnion, and wherein the ends of said first and second upper and lower channel members are pivotally attached by the following process to said first and second pivot pins, forming pin receiving openings and adjoining tab portions (47, 48) that are bent ninety degrees relative to the side planar surfaces in the ends of said first and second upper and lower channel members, inserting said first and second pivot pins into said pin receiving openings, and then bending said tab portions (47, 48) so that they lie in the plane of said side planar surfaces of said first and second upper and lower channel members.

2. A scissors jack according to claim 1 comprising a partial bearing surface for said pivot pins which extends beyond the side planar surface of said channel member.

3. A scissors jack according to claim 2 comprising a curved portion between the opposite ends of said partial bearing surface and two of said tab portions.

* * * * *